United States Patent [19]

Yamaguchi et al.

[11] 4,120,079

[45] Oct. 17, 1978

[54] TOW OPENING APPARATUS

[75] Inventors: Masataka Yamaguchi; Saeko Yamaguchi; Tadashi Ohokubo, all of Tokyo, Japan

[73] Assignee: Tokyo Institute of Technology, Tokyo, Japan

[21] Appl. No.: 841,129

[22] Filed: Oct. 11, 1977

[51] Int. Cl.[2] ..... D01D 11/02

[52] U.S. Cl. ..... 28/282

[58] Field of Search ..... 19/65 T, 66 T; 28/220, 28/282

[56] References Cited

U.S. PATENT DOCUMENTS

| | | | |
|---|---|---|---|
| 1,951,181 | 3/1934 | Battin | 28/282 X |
| 2,822,582 | 2/1958 | Hayward et al. | 19/65 T |
| 3,708,832 | 1/1973 | Lohrke | 28/282 |

*Primary Examiner*—Dorsey Newton

*Attorney, Agent, or Firm*—Burgess, Ryan and Wayne

[57] ABSTRACT

A tow opening apparatus for opening tow of chemical filaments wherein a plurality of opening disks each with the interior peripheral surface formed with a plurality of small ridges and valleys and a plurality of opening disks each with the peripheral surface formed with a plurality of ridges and valleys are alternately disposed and vertically spaced apart from each other by a suitable distance, and tow filaments are brought into alternate contact with the interior peripheral surfaces of the opening rings and the peripheral surfaces of the opening disks whereby said filaments are opened and oriented in parallel relationship.

5 Claims, 15 Drawing Figures

TOW OPENING APPARATUS

BACKGROUND OF THE INVENTION

The present invention relates to an apparatus for effectively opening entangled chemical filaments of tow.

In general tow is composed of a large number of long chemical filaments of thousands to millions denier gathered together, and because of the properties of the filaments, the spinning conditions, the crimps imparted to the filaments and so on, the tow filaments have a strong tendency for entangling with each other. As a result, in the tow spinning process, the fibers are irregularly drafted so that the resulting yarns vary in size or fineness. This problem may be substantially solved by sufficiently opening the filaments of raw tow. Therefore there had been a strong demand for an apparatus which may effectively and easily open the filaments of tow and orient them in parallel relationship without causing damages to and drawing of the filaments at a low cost and which may continuously deliver the opened fibers to the next processing station or frame.

The prior art tow opening apparatus employs rollers for opening tow filaments so that the tow filaments are only two-dimensionally opened. As a result the tow filaments are not imparted with the uniform tensions so that a small group of entangled filaments results. Furthermore since the opening is two-dimensional as described above, the prior art tow opening apparatus is large in size and consequently a large installation space is required.

SUMMARY OF THE INVENTION

One of the objects of the present invention is therefore to provide an apparatus capable of effectively opening chemical tow filaments and orienting them in parallel relationship.

Another object of the present invention is to provide a tow opening apparatus which may substantially solve the problems encountered in the prior art apparatus that due to the nonuniform tensions and variation in tension imparted to the filaments, the number of filaments collected varies and that small groups of entangled filaments are left disentangled or unopened.

A further object of the present invention is to provide a tow opening apparatus which may three-dimensionally open tow filaments so that the apparatus may be made compact in size and consequently the installation space may be considerably reduced.

A still further object of the present invention is to provide a tow opening apparatus which may collect the opened and parallelized tow filaments again into a tow which in turn may be continuously delivered to a tow spinning frame.

BRIEF DESCRIPTION OF THE DRAWINGS

FIG. 2(*b*) is a sectional view taken along the line II*b* — II*b* of FIG. 2(*a*);

FIG. 2(*c*) is a perspective view thereof;

FIG. 3(*b*) is a sectional view taken along the line III*b* — III*b* of FIG. 3(*a*);

FIGS. 3(*c*) and 3(*d*) are side and perspective views, respectively, thereof;

FIG. 4(*b*) is a sectional view taken along the line IV*b* — IV*b* of FIG. 4(*a*);

FIG. 4(*c*) is a perspective view thereof;

FIG. 5(*b*) is a sectional view taken along the line V*b* — V*b* of FIG. 5(*a*); and FIGS. 5(*c*) and 5(*d*) are side and perspective views, respectively, thereof.

DESCRIPTION OF THE PREFERRED EMBODIMENTS

Figure 1:
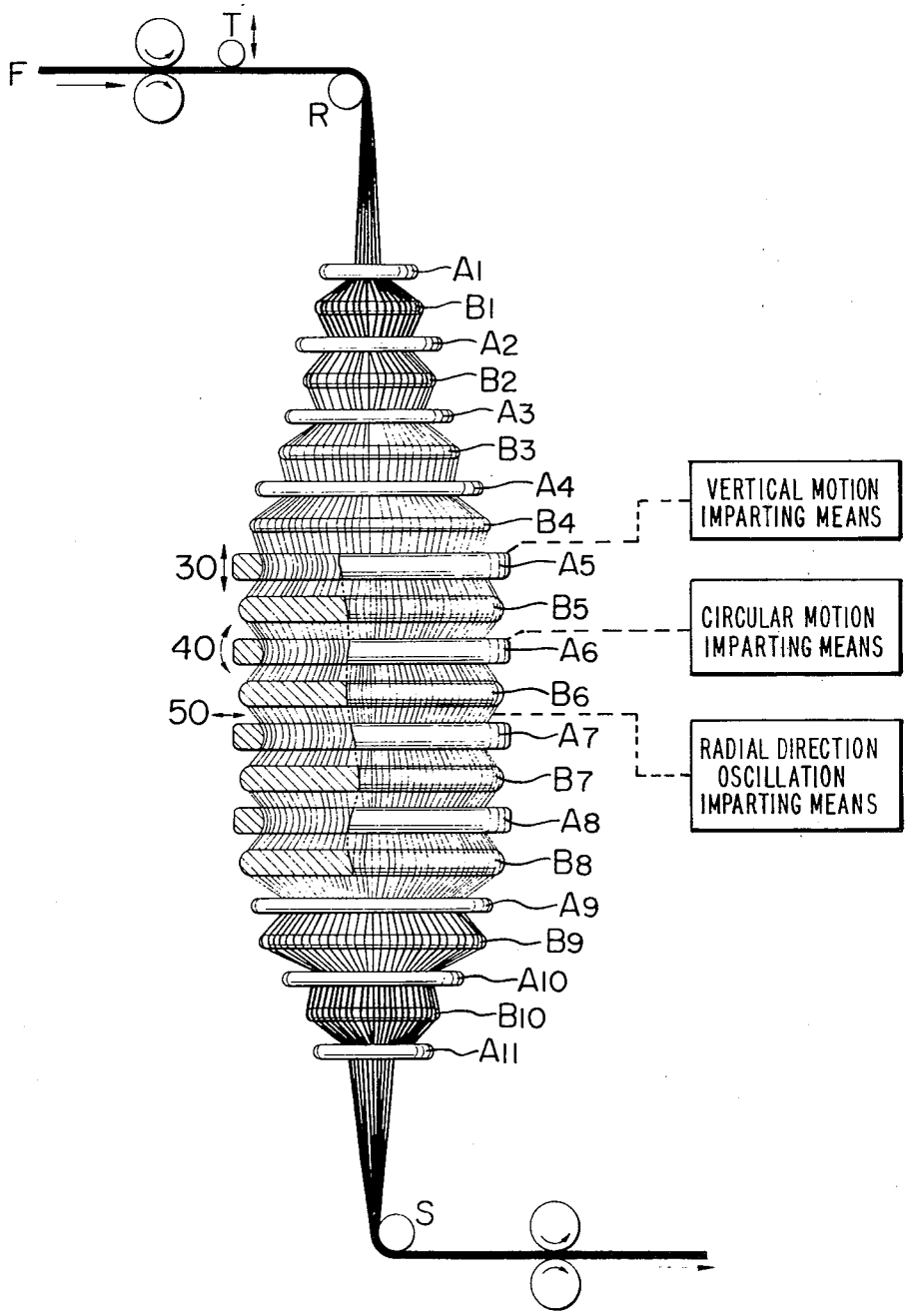
FIG. 1 is a front view, partly broken away, of one preferred embodiment of a tow opening apparatus in accordance with the present invention.

In FIG. 1 there is shown a tow opening apparatus in accordance with the present invention including a pair of feed rollers, a tension roller T, a guide roller R, opening rings $A_1$–$A_{11}$ and opening disks $B_1$–$B_{10}$, which are alternately coaxially disposed and vertically spaced apart from each other by suitable distances, and a collection roller S. The guide roller R and the collection roller S are so positioned that the diverging and converging points of the tow filaments may be coaxial with the opening rings $A_1$–$A_{11}$ and opening disks $B_1$–$B_{10}$.

Tow is fed through the feed rollers, imparted with a suitable tension by the tension roller T and guided downward by the guide roller R. The opened tow filaments are first brought into contact with the inner peripheral surface of the first opening ring $A_1$ and then the peripheral surface of the first opening disk $B_1$. In like manner, the tow filaments are made to pass in alternate contact with the opening rings $A_2$–$A_{11}$ and opening disks $B_2$–$B_{10}$ and are finally collected by the collection roller S into a tow which in turn is continuously fed to a tow spinning frame or broken or cut into short staple lengths for various purposes.

In FIG. 1 there is shown in detail a typical one of the opening rings $A_1$–$A_{11}$ of the tow opening apparatus shown in FIG. 1. The interior peripheral surface of the opening ring A is formed with a large number of small protrusions 10 or ridges and valleys. In like manner, the peripheral surface of the opening disk B is formed with a large number of small protrusions 10' or ridges and valleys as shown in FIG. 3(*a*). These protrusions or ridges and valleys 10 and 10' serve to uniformly circumferentially open and divide the tow filaments while they are pulled downward in a zig-zag manner in contact with the opening rings $A_1$–$A_{11}$ and opening disks $B_1$–$B_{10}$ so that the tow filaments extended between the guide roller R and the collection roller S become the same in length, are oriented in uniform parallel relationship, and are imparted with the uniform tension.

Figure 2A:
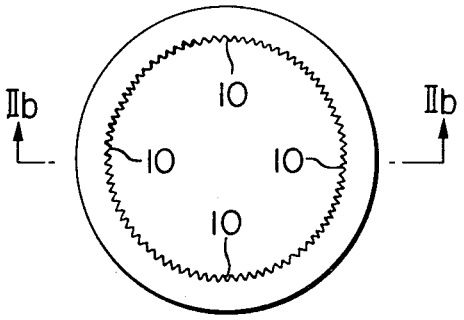
FIG. 2(*a*) is a top view of an opening ring used in the apparatus shown in FIG. 1.
Figure 3A:
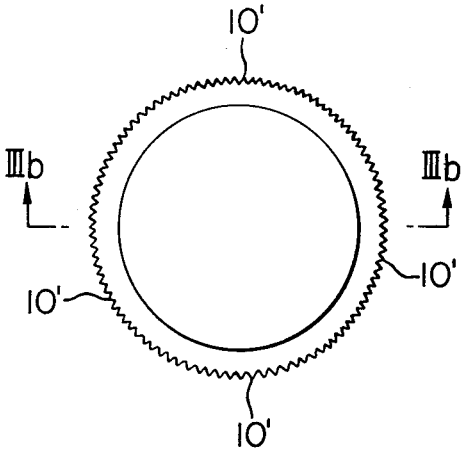
FIG. 3(*a*) is a top view of an opening disk used in the apparatus shown in FIG. 1.
Figure 2B:
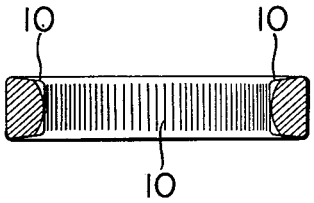
Figure 3B:
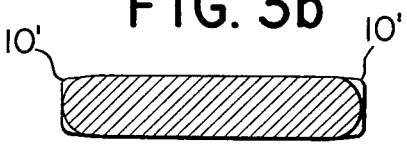
Figure 3C:
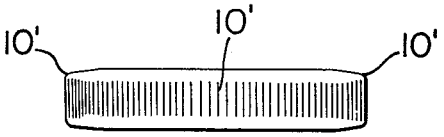
Figure 2C:
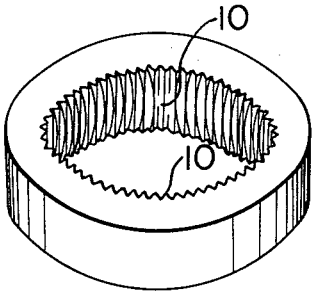
Figure 3D:
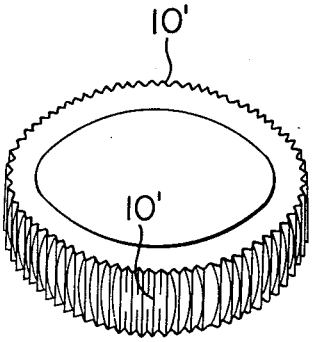
Figure 4A:
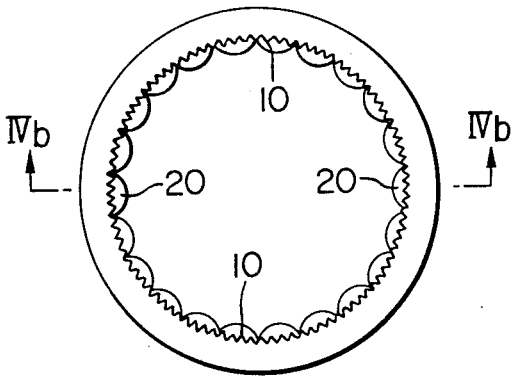
FIG. 4(*a*) is a top view of another embodiment of the opening ring.
Figure 4B:
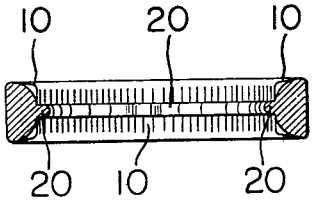
Figure 4C:
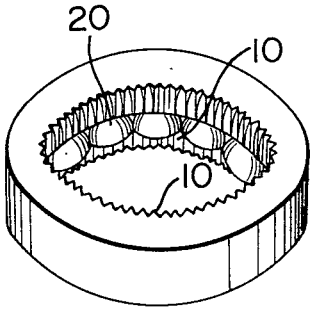
Figure 5A:
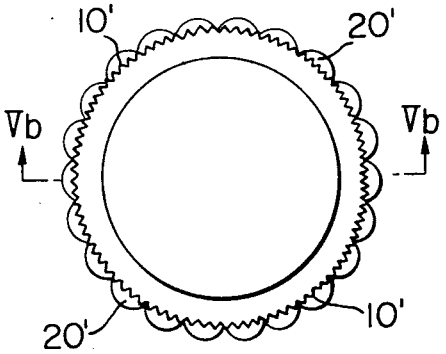
FIG. 5(*a*) is a top view of another embodiment of the opening disk.
Figure 5B:
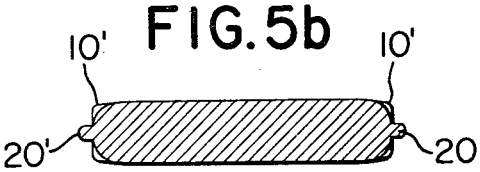
Figure 5C:
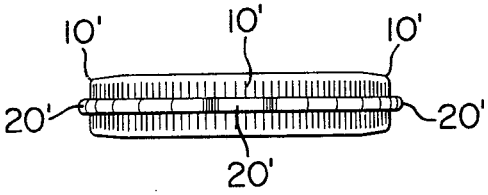
Figure 5D:
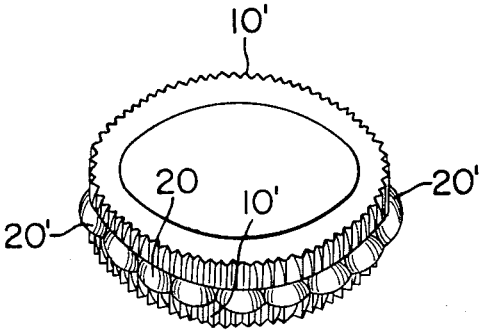

In FIGS. 4(*a*)–4(*c*) and 5(*a*)–5(*d*) there are shown another embodiments of the opening rings A and opening disks B. In addition to the small protrusions or ridges and valleys 10 or 10', each opening ring or disk is formed with a plurality of semicircular projections 20 or 20' radially inwardly or outwardly extended beyond the protrusions or ridges 10 or 10' between the upper and lower ends thereof. Therefore the tow filaments are first coarsely opened and oriented in parallel relationship by the large projections 20 and 20' and then finely opened and oriented in parallel relationship by the small protrusions or ridges and valleys 10 and 10'. Thus, as compared with the opening rings and disks of the types shown in FIGS. 2(*a*)–2(*c*) and 3(*a*)–3(*d*), the tow filaments may be more uniformly and efficiently opened and made parallel to each other.

Referring back to FIG. 1, some of the opening rings A and disks B may be oscillated vertically as indicated by the double-pointed arrow 30, or may be swung as indicated by the double-pointed arrow 40; or the tow filaments may be oscillated in the radial direction between a preselected pair of opening ring and disk as indicated by the double-pointed arrow 50 so that the tow opening effects may be further improved. Furthermore, the inner diameter and outer diameter of the adjacent opening ring and disk may be varied suitably, as for example shown in FIG. 1. Moreover, the shape and size of the small protrusions 10 and 10' and large projections 20 and 20' may be suitably varied. Thus the angle of contact of the tow filament with the opening ring or disk may be varied depending upon the degree of entanglement of a tow to be opened, so that optimum opening effects may be attained.

What is claimed is:

1. A filamentary tow opening apparatus, comprising:

a plurality of opening rings each having a plurality of small protrusions or ridges and valleys formed on the interior peripheral surfaces thereof, a plurality of opening disks each having a plurality of small protrusions or ridges and valleys formed on the exterior peripheral surfaces thereof, said plurality of opening rings and said plurality of opening disks being alternately disposed and vertically spaced apart from each other by a suitable distance, and means for feeding tow filaments to, and discharging said filaments from, said plurality of rings and disks in alternate contact with the interior peripheral surfaces of said opening rings and the exterior peripheral surfaces of said opening disks, whereby said tow filaments are opened.

2. A filamentary tow opening apparatus as set forth in claim 1 wherein each of said opening rings and disks is formed with a plurality of arcuate large projections extended from the interior peripheral surface or the peripheral surface beyond said protrusions or ridges and vallyes between the upper and lower ends thereof.

3. A filamentary tow opening apparatus as set forth in claim 1 further comprising means for imparting a vertical motion to predetermined opening disks and rings.

4. A filamentary tow opening apparatus as set forth in claim 1, further comprising means for imparting a circular motion to predetermined opening rings and disks.

5. A filamentary tow opening apparatus as set forth in claim 1, further comprising means for imparting oscillation to the tow filaments in a radial direction between a preselected opening ring and disk.

* * * * *

UNITED STATES PATENT OFFICE

CERTIFICATE OF CORRECTION

Patent No. 4,120,079 Dated October 17, 1978

Inventor(s) Masataka Yamaguchi, et al

It is certified that error appears in the above-identified patent and that said Letters Patent are hereby corrected as shown below:

Column 2, line 58: "another" should be --other--.

Column 4, line 19: "vallyes" should be --valleys--

Signed and Sealed this

*Ninth* Day of *October 1979*

[SEAL]

*Attest:*

RUTH C. MASON
*Attesting Officer*

LUTRELLE F. PARKER
*Acting Commissioner of Patents and Trademark*